US007717278B2

(12) United States Patent
Kao

(10) Patent No.: US 7,717,278 B2
(45) Date of Patent: May 18, 2010

(54) TOOL SUSPENSION DEVICE

(76) Inventor: Jui-Chien Kao, No. 358, Tunghsing Rd., Shuwang Li, Tali City, Taichung Hsien (TW)

( * ) Notice: Subject to any disclaimer, the term of this patent is extended or adjusted under 35 U.S.C. 154(b) by 163 days.

(21) Appl. No.: 12/168,196

(22) Filed: Jul. 7, 2008

(65) Prior Publication Data

US 2010/0001159 A1 Jan. 7, 2010

(51) Int. Cl.
*A47B 73/00* (2006.01)

(52) U.S. Cl. ..... 211/70.6; 206/349; 206/376; 211/94.01

(58) Field of Classification Search ..... 211/61, 211/66, 70.6, 87.01, 175; 206/349, 378, 206/376; 248/111, 113, 223.41, 231.85, 248/316.4

See application file for complete search history.

(56) References Cited

U.S. PATENT DOCUMENTS 4,705,177 A * 11/1987 Oren ..... 211/70.5
5,109,992 A * 5/1992 Miller ..... 211/59.1
5,165,629 A * 11/1992 Breveglieri ..... 248/110
6,435,357 B1 * 8/2002 Lee ..... 211/70.6
6,626,402 B1 * 9/2003 Kaminstein ..... 248/110
7,198,158 B2 * 4/2007 Kao ..... 211/70.6
2006/0234846 A1 * 10/2006 Tucker ..... 483/26
2008/0000853 A1 * 1/2008 Huang ..... 211/70.6
2009/0120885 A1 * 5/2009 Kao ..... 211/70.6
2009/0194494 A1 * 8/2009 Kao ..... 211/70.6
2009/0242497 A1 * 10/2009 Nilsson et al. ..... 211/70.6
2010/0001159 A1 * 1/2010 Kao ..... 248/316.4

* cited by examiner

*Primary Examiner*—Ramon O Ramirez
(74) *Attorney, Agent, or Firm*—Hershkovitz & Associates, LLC; Abraham Hershovitz

(57) ABSTRACT

A tool suspension device has a base bracket, multiple clamping elements and multiple sliding elements. The base bracket has a baseboard and a rail bracket. The rail bracket is formed on the baseboard and has an inner rail and an outer rail. The clamping elements are mounted slidably on the rail bracket and each has two clamps in pairs. Each clamp is mounted slidably on the outer rail and has two hooks and an arm. The hooks are mounted slidably in the outer rail. The arm is formed with the hooks and has a mounting hole. The sliding elements are mounted slidably in the rail bracket, are connected to the clamping elements and each has two sliding plates and two adjusting bolts. The sliding plates are mounted in the inner rail. The adjusting bolts are mounted in the mounting holes and connected to the sliding plates.

12 Claims, 7 Drawing Sheets

TOOL SUSPENSION DEVICE

BACKGROUND OF THE INVENTION

1. Field of the Invention

The present invention relates to a tool suspension device, especially to a tool suspension device that can be movably adjusted to hold tools conveniently and easily.

2. Description of the Prior Arts

A conventional suspension device is used to hold tools such as wrenches, screwdrivers or sockets on a wall and has a baseboard and multiple stationary holders. The baseboard has multiple hanging holes formed through the baseboard to allow the baseboard to be mounted on the wall by fasteners. The stationary holders are fixed loops connected securely to the baseboard to hold tools on the conventional suspension device.

However, the stationary holders are immovably connected to the baseboard and an interval between adjacent stationary holders is fixed, the interval between adjacent stationary holders cannot be adjusted to match different widths of different tools, and this is inconvenient in use.

To overcome the shortcomings, the present invention provides a tool suspension device to mitigate or obviate the aforementioned problems.

SUMMARY OF THE INVENTION

The main objective of the present invention is to provide a tool suspension device that can be movably adjusted to hold tools conveniently and easily.

The tool suspension device in accordance with the present invention has a base bracket, multiple clamping elements and multiple sliding elements. The base bracket has a baseboard and a rail bracket. The rail bracket is formed on the baseboard and has an inner rail and an outer rail. The inner rail has two rail panels and two sliding grooves. The clamping elements are mounted slidably on the rail bracket and each clamping element has two clamps in pairs. Each clamp is mounted slidably on the outer rail of the rail bracket and has two hooks and an arm. The hooks are mounted slidably in the outer rail. The arm is formed on and protrudes out from the hooks and has a jaw recess and a mounting hole. The mounting hole is formed through the arm and communicates with the inner rail. The sliding elements are mounted slidably in the rail bracket, are connected to the clamping elements and each sliding element has two sliding plates and two adjusting bolts. The sliding plates are respectively mounted in the sliding grooves of the inner rail. The adjusting bolts are mounted in and extended through the mounting holes of the clamps and are respectively connected to the sliding plates.

Other objectives, advantages and novel features of the invention will become more apparent from the following detailed description when taken in conjunction with the accompanying drawings.

DETAILED DESCRIPTION OF PREFERRED EMBODIMENTS

Figure 1:
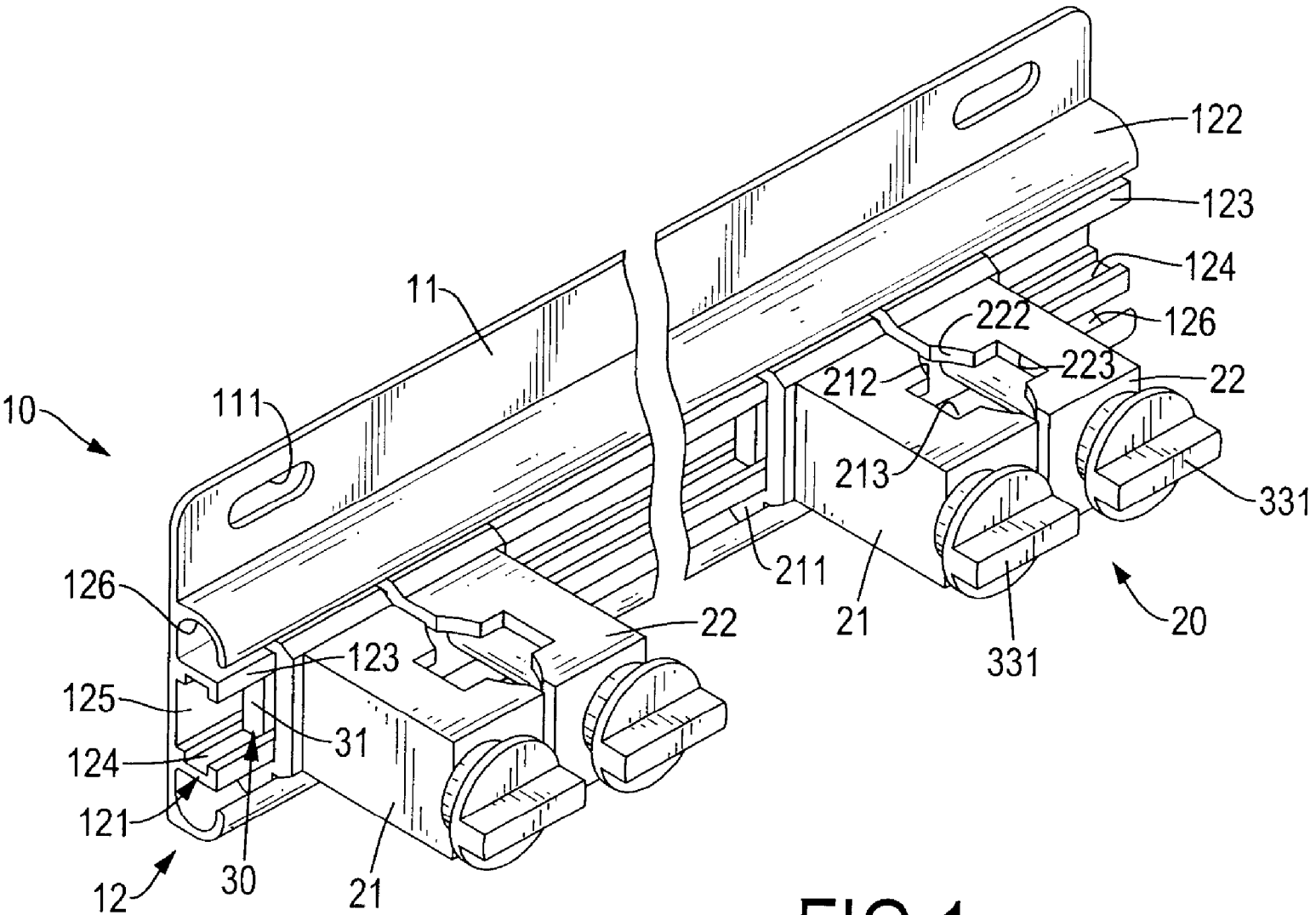
FIG. 1 is a perspective view of a tool suspension device in accordance with the present invention.
Figure 2:
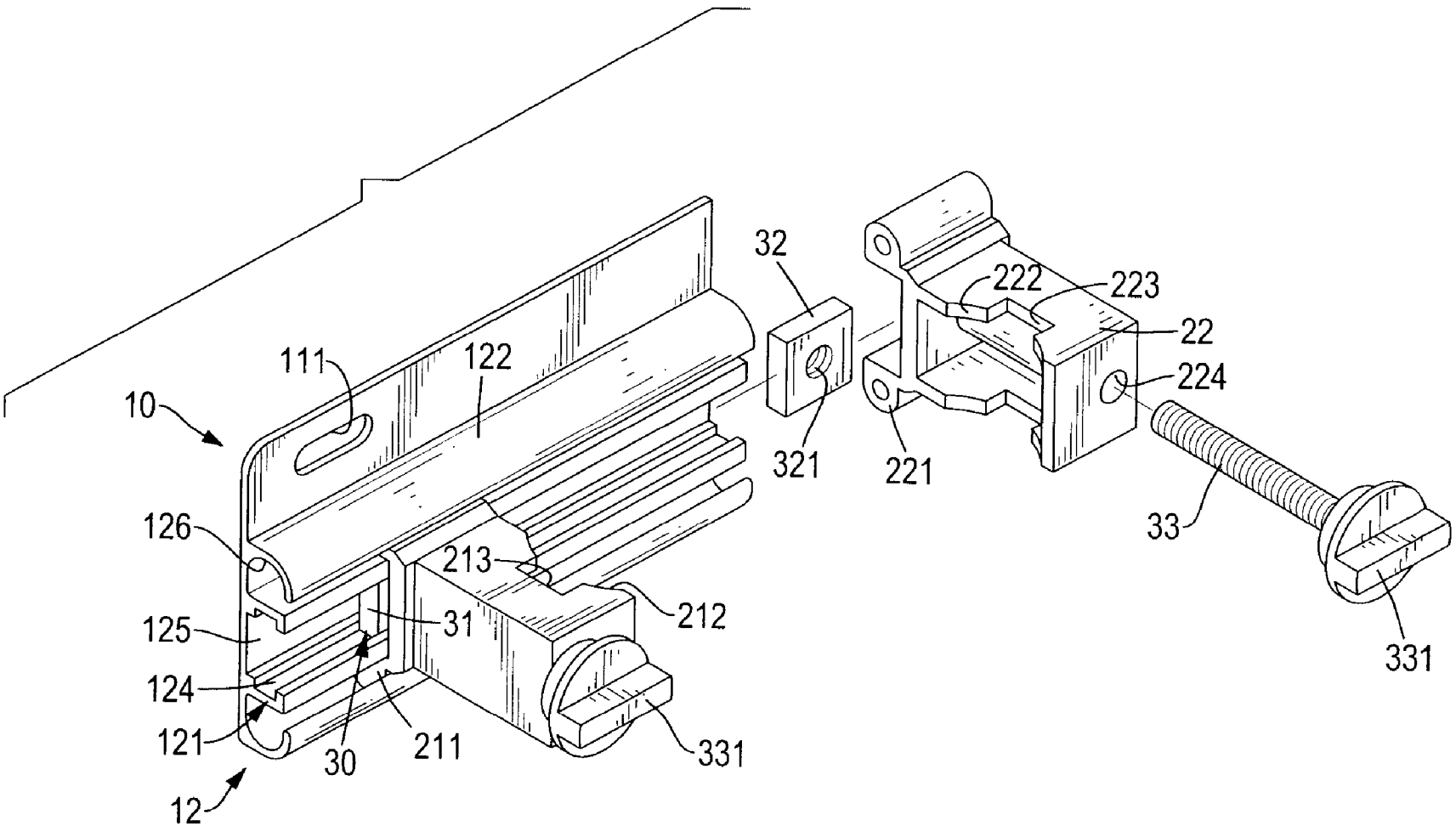
FIG. 2 is an enlarged partially exploded perspective view of the tool suspension device in FIG. 1.
Figure 4:
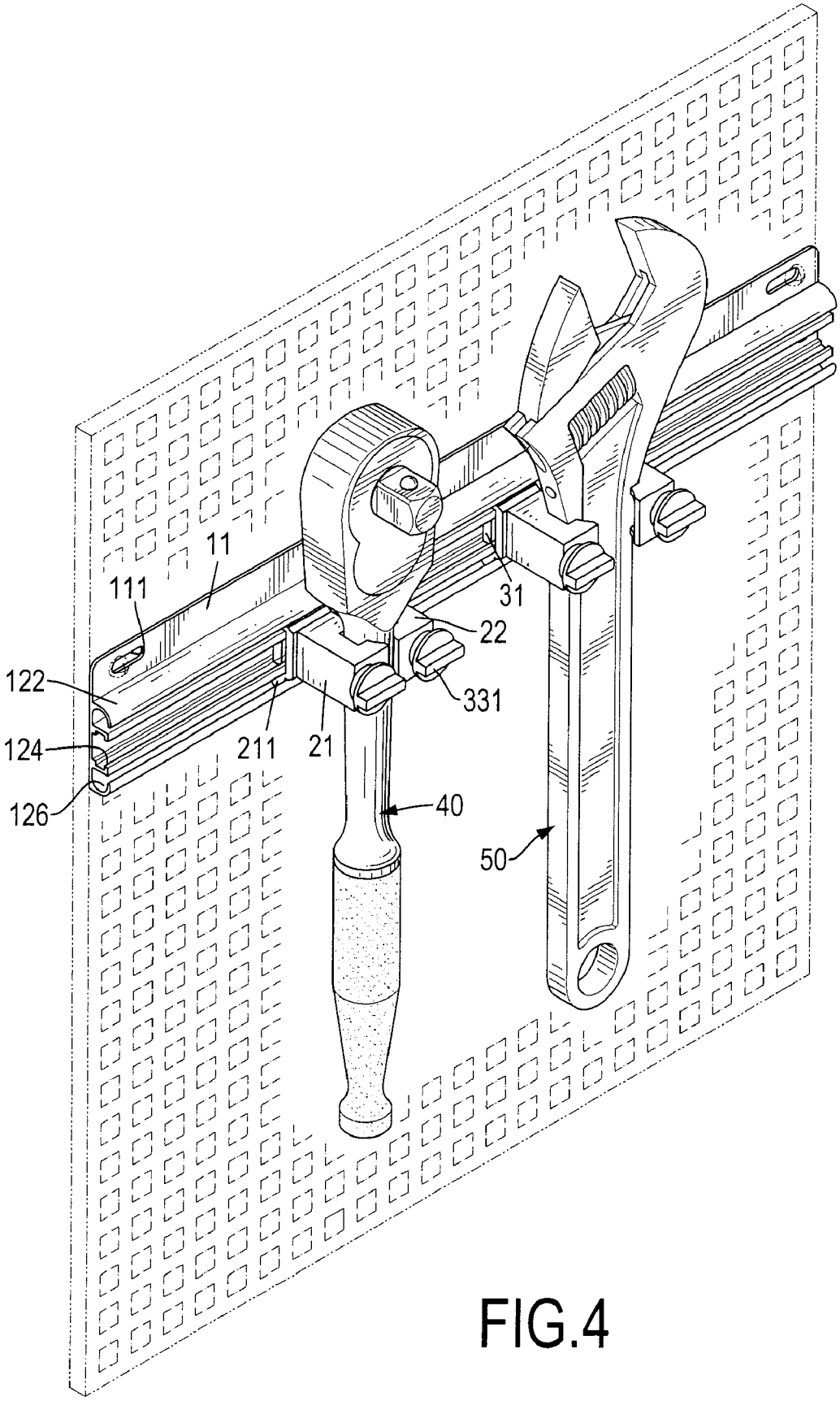
FIG. 4 is a perspective view of the tool suspension device in FIG. 1 hung on a perfboard with a socket wrench and a monkey wrench.

With reference to FIGS. 1, 2 and 4, a tool suspension device in accordance with the present invention has a base bracket (10), multiple clamping elements (20) and multiple sliding elements (30).

The base bracket (10) may be hang on a mounting surface such as a wall, a perfboard or other such vertical surface and has a baseboard (11) and a rail bracket (12).

The baseboard (11) has a front surface and multiple optional hanging holes (111). The hanging holes (111) are formed through the baseboard (11) to make the baseboard (11) mounting on the wall or the perfboard.

The rail bracket (12) is formed on the front surface of the baseboard (11) and has an inner rail (121) and an outer rail (122).

The inner rail (121) is formed on the front surface of the baseboard (11) and has two rail panels (123) and an optional chamber (125). The rail panels (123) are transversely formed on the front surface of the baseboard (11) and are parallel with each other, and each rail panel (123) has an inner surface, an outer surface and a sliding groove (124). The inner surfaces of the rail panels (123) face to each other. The sliding grooves (124) are respectively formed in the inner surfaces of the rail panels (123). The chamber (125) is defined in the inner rail (121) between the rail panels (123) and the front surface of the baseboard (11) and communicates with the sliding grooves (124).

The outer rail (122) is formed on the front surface of the baseboard (11) and has two curved panels and two inserting grooves (126). The curved panels are formed transversely formed on the front surface of the baseboard (11) and are bent toward the rail panels (123) of the inner rail (122) to form the inserting grooves (126) between the outer rail (122) and the rail panels (123) of the inner rail (121).

Figure 3:
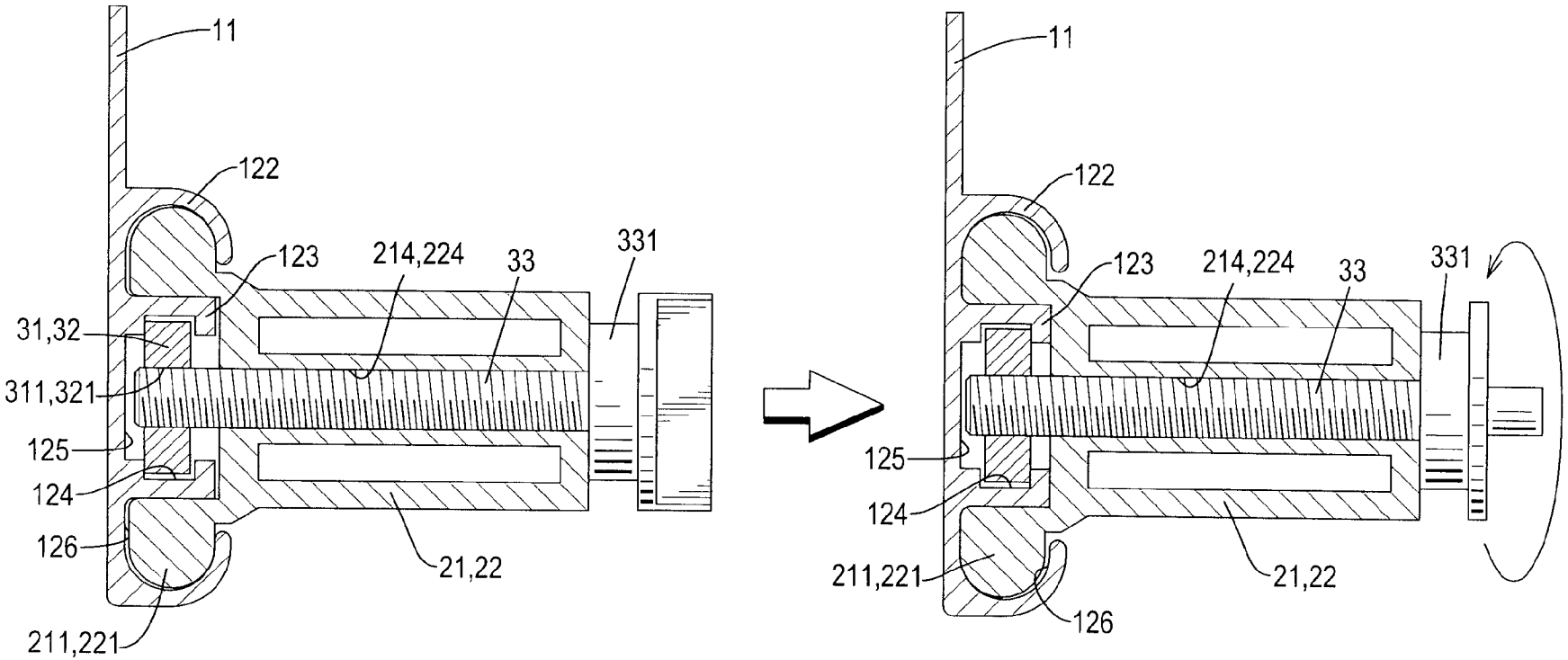
FIG. 3 is an enlarged operational side view in partial section of the tool suspension device in FIG. 1.

With further reference to FIG. 3, the clamping elements (20) are mounted slidably on the rail bracket (12) of the base bracket (10) and each clamping element (20) has two clamps (21, 22) in pairs. Each clamp (21, 22) is mounted slidably on the outer rail (122) of the rail bracket (12) and has a proximal end, two hooks (211, 221) and an arm.

The hooks (211, 221) are formed on the proximal end of the clamp (21, 22), corresponding to and are respectively mounted slidably in the inserting grooves (126) of the outer rail (122) of the rail bracket (12).

The arm of the clamp (21, 22) is formed on and protrudes out from the hooks (211, 221) and has a side surface, a distal end, a jaw recess (212, 222) and a mounting hole (214, 224). The side surfaces of two corresponding arms (21) face to each other. The jaw recess (212, 222) is formed in the side surface of the arm (21, 22) and may be curved and have a middle and a rectangular recess (213, 223). The rectangular recess (213, 223) is formed in the middle of the jaw recess (212, 222). The mounting hole (214, 224) is formed through the arm of the clamp (21, 22) and communicates with the chamber (125) of the inner rail (121) in the rail bracket (12).

The sliding elements (30) are mounted slidably in the rail bracket (12) of the base bracket (10) and are connected to the clamping elements (20), and each sliding element (30) has two sliding plates (31, 32) and two adjusting bolts (33).

The sliding plates (31, 32) are respectively mounted in the sliding grooves (124) of the inner rail (121) of the rail bracket (12) and each sliding plate (31, 32) has a connecting hole (311, 321). The connecting hole (311, 321) is formed through the sliding plate (31, 32), aligns with the mounting hole (214, 224) of the clamp (21, 22) and has an inner thread.

The adjusting bolts (33) are mounted in and extended through the mounting holes (214, 224) via the holes in the clamps (21, 22) and are respectively connected to the sliding plates (31, 32). Each adjusting bolt (33) has an inner end, an outer end, an external surface, an outer thread and an operating head (331). The inner end of the adjusting bolt (33) extends through the mounting hole (214, 224) of a corresponding clamp (21, 22) and is mounted in the chamber (125) of the inner rail (121). The outer thread is formed around the external surface of the adjusting bolt (33) and is screwed with the inner thread of the connecting hole (311, 321) of a corresponding sliding plate (31, 32). The outer end of the adjusting bolt (33) extends out of the distal end of the arm of the corresponding clamp (21, 22). The operating head (331) is formed on the outer end of the adjusting bolt (33).

After loosening the adjusting bolt (33) relative to the corresponding sliding plate (31, 32) by rotating the operating head (331), the corresponding clamp (21, 22) can be moved relative to the base bracket (10) to adjust an interval between the corresponding pair of clamps (21, 22). When two adjacent clamps (21, 22) are adjusted to a desired interval, the operating head (331) is rotated in reverse to fasten the adjusting bolt (33) with the sliding plate (31, 32) to make the sliding plate (31, 32) abutting with the rail panels (123) of the inner rail (121). Then, the corresponding clamp (21, 22) is held immovably on the rail bracket (12) for clamping different size or kind tools on the tool suspension device.

With further reference to FIG. 4, the base bracket (10) of the tool suspension device is hung on a perfboard, and a tool such as, but not limited to a socket wrench (40) or a monkey wrench (50) can be clamped between the clamps (21, 22).

Figure 5:
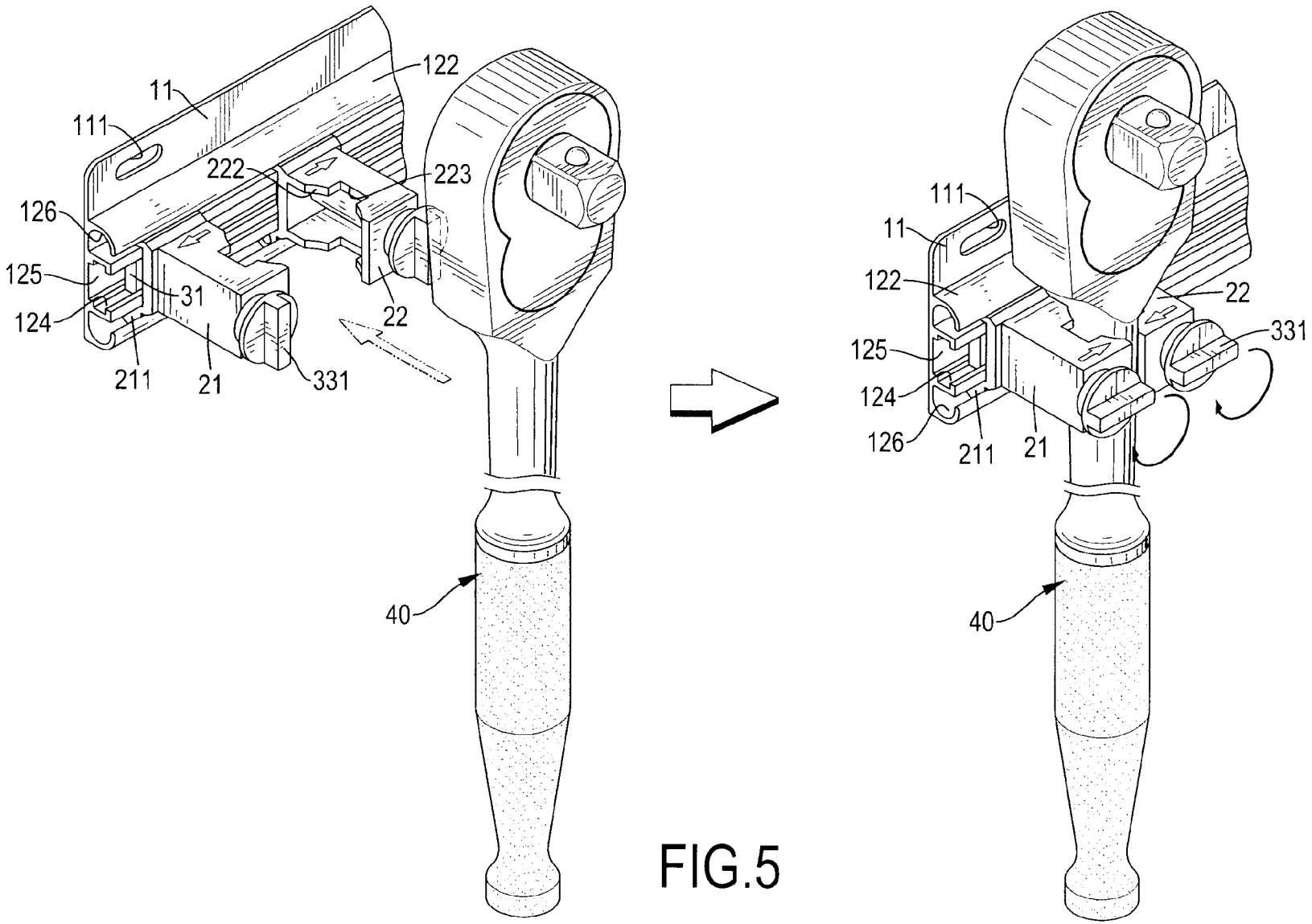
FIG. 5 is an operational perspective view of the tool suspension device in FIG. 1 to hold the socket wrench.
Figure 6:
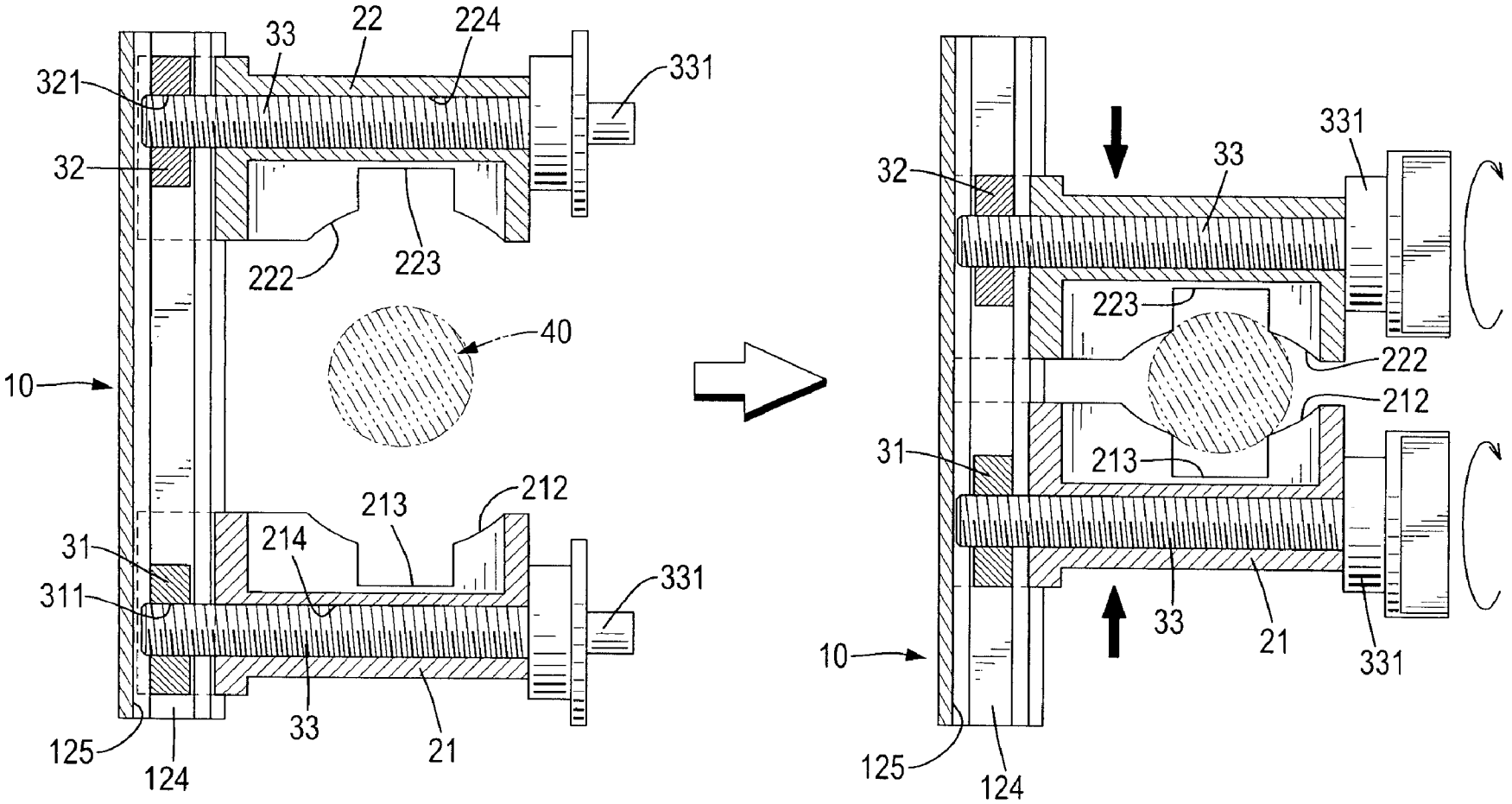
FIG. 6 is an operational top view in partial section of the tool suspension device in FIG. 1 to hold the socket wrench.
Figure 7:
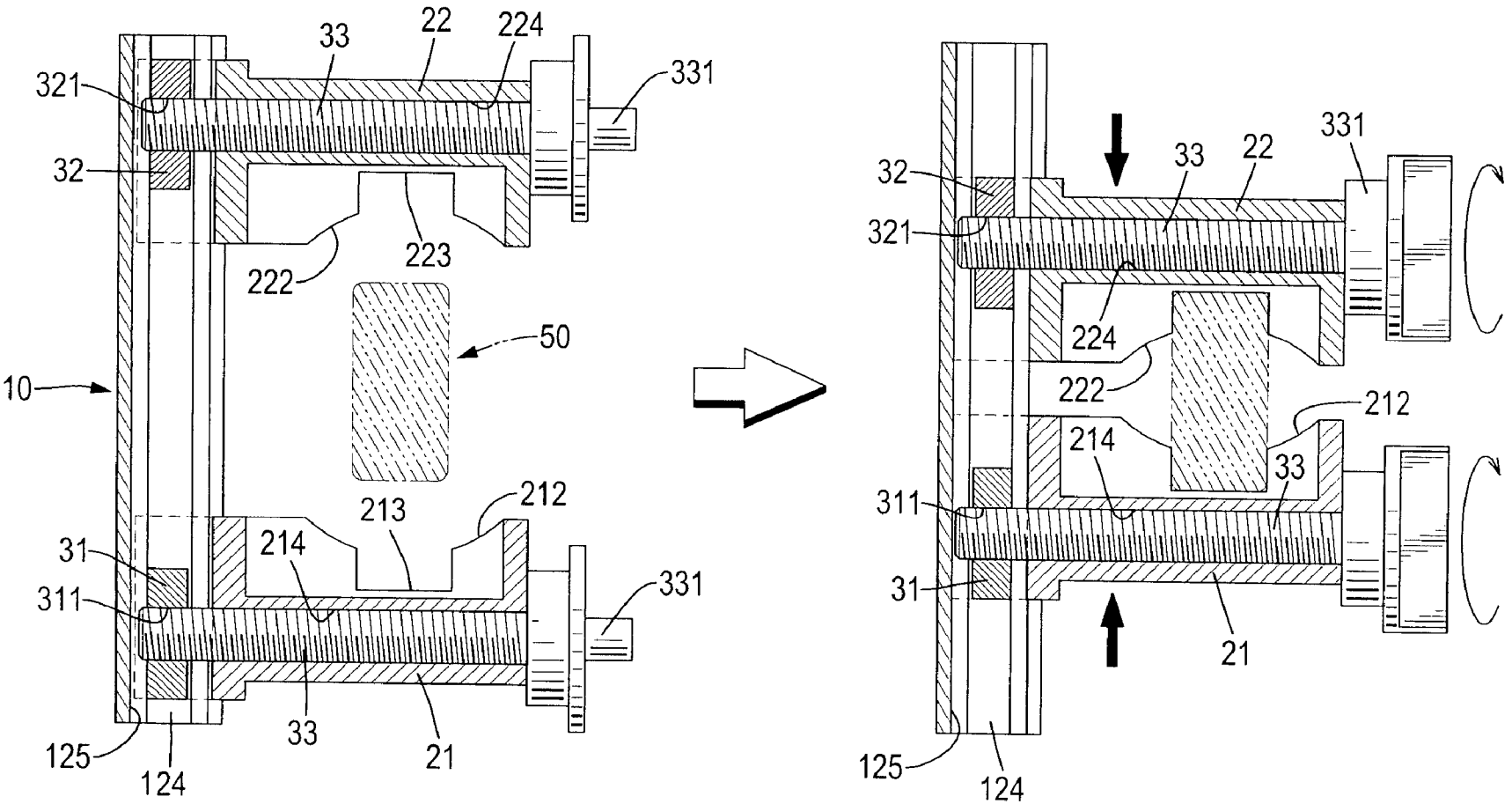
FIG. 7 is an operational top view in partial section of the tool suspension device in FIG. 1 to hold the monkey wrench.

With further reference to FIGS. 5 to 7, the clamps (21, 22) are separated to allow the wrench (40, 50) to be placed between the clamps (21, 22). Then, the clamps (21, 22) are moved close to clamp the wrench (40, 50) in the jaw recesses (212, 222) or in the rectangular recesses (213, 223). Since the adjusting bolts (33) push the sliding plates (31, 32) abutting with the rail panels (123) of the inner rail (121), the clamps (21, 22) are held securely on the base bracket (10) to hold the wrenches (40, 50) conveniently and easily.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A tool suspension device comprising a base bracket having a baseboard having a front surface; and a rail bracket being formed on the front surface of the baseboard and having an inner rail being formed on the front surface of the baseboard and having two rail panels being transversely formed on the front surface of the baseboard and being parallel each other, and each rail panel having an inner surface facing to the inner surface of the other rail panel;

an outer surface; and a sliding groove being formed on the inner surface of the rail panel; and an outer rail being formed on the front surface of the baseboard;

multiple clamping elements being mounted slidably on the rail bracket of the base bracket and each clamping element having two clamps in pairs and each clamp being mounted slidably on the outer rail of the rail bracket and having a proximal end;

two hooks being formed on the proximal end of the clamp and being mounted slidably in the outer rail of the rail bracket; and an arm being formed on and protruding out from the hooks and having a side surface;

a distal end;

a jaw recess being formed in the side surface of the arm; and a mounting hole being formed through the arm of the clamp and communicating with the sliding grooves of the inner rail in the rail bracket; and multiple sliding elements being mounted slidably in the rail bracket of the base bracket and being connected to the clamping elements, and each sliding element having two sliding plates being respectively mounted in the sliding grooves of the inner rail of the rail bracket and each sliding plate having a connecting hole being formed through the sliding plate and aligning with the mounting hole of a corresponding clamp; and two adjusting bolts being mounted in and extended through the mounting holes of corresponding clamps and being respectively connected to the sliding plates, and each adjusting bolt having an inner end being extended through the mounting hole of a corresponding clamp; and an outer end being extended out of the distal end of the arm of the corresponding clamp.

2. The tool suspension device as claimed in claim 1, wherein the outer rail further has two inserting grooves; and two curved panels being formed transversely formed on the front surface of the baseboard and being bent toward the rail panels of the inner rail to form the inserting grooves between the outer rail and the rail panels of the inner rail; and the hooks of each clamp are respectively mounted slidably in the inserting grooves.

3. The tool suspension device as claimed in claim 2, wherein each adjusting bolt further has an operating head being formed on the outer end of the adjusting bolt.

4. The tool suspension device as claimed in claim 3, wherein the inner rail further has a chamber being defined in the inner rail between the rail panels and the front surface of the baseboard and communicating with the sliding grooves;

the mounting hole of each clamp communicates with the chamber of the inner rail; and the inner end of each adjusting bolt is mounted in the chamber of the inner rail.

5. The tool suspension device as claimed in claim 4, wherein each jaw recess is curved and further has a middle; and a rectangular recess being formed in the middle of the jaw recess.

6. The tool suspension device as claimed in claim 5, wherein the baseboard further has multiple hanging holes being formed through the baseboard.

7. The tool suspension device as claimed in claim 6, wherein the connecting hole of each sliding plate has an inner thread; and each adjusting bolt has an external surface; and an outer thread being formed around the external surface of the adjusting bolt and being screwed with the inner thread of the connecting hole of a corresponding sliding plate.

8. The tool suspension device as claimed in claim 1, wherein each adjusting bolt further has an operating head being formed on the outer end of the adjusting bolt.

9. The tool suspension device as claimed in claim 1, wherein the inner rail further has a chamber being defined in the inner rail between the rail panels and the front surface of the baseboard and communicating with the sliding grooves;

the mounting hole of each clamp communicates with the chamber of the inner rail; and the inner end of each adjusting bolt is mounted in the chamber of the inner rail.

10. The tool suspension device as claimed in claim 1, wherein each jaw recess is curved and further has a middle; and a rectangular recess being formed in the middle of the jaw recess.

11. The tool suspension device as claimed in claim 1, wherein the baseboard further has multiple hanging holes being formed through the baseboard.

12. The tool suspension device as claimed in claim 1, wherein the connecting hole of each sliding plate has an inner thread; and each adjusting bolt further has an external surface; and an outer thread being formed around the external surface of the adjusting bolt and being screwed with the inner thread of the connecting hole of a corresponding sliding plate.

* * * * *